US011856994B1

(12) United States Patent
Glaser

(10) Patent No.: US 11,856,994 B1
(45) Date of Patent: Jan. 2, 2024

(54) E-CIGARETTES, E-CIGARS, VAPE-DEVICE PUBLIC SAFETY AND PROTECTION MECHANISMS

(71) Applicant: Lawrence F Glaser, Needles, CA (US)

(72) Inventor: Lawrence F Glaser, Needles, CA (US)

( * ) Notice: Subject to any disclaimer, the term of this patent is extended or adjusted under 35 U.S.C. 154(b) by 0 days.

(21) Appl. No.: 17/742,832

(22) Filed: May 12, 2022

Related U.S. Application Data

(63) Continuation of application No. 16/935,695, filed on Jul. 22, 2020, now Pat. No. 11,369,148, which is a continuation-in-part of application No. 15/008,500, filed on Jan. 28, 2016, now Pat. No. 10,178,879.

(60) Provisional application No. 62/109,246, filed on Jan. 29, 2015.

(51) Int. Cl.
*A24F 40/485* (2020.01)
*A24F 40/65* (2020.01)

(52) U.S. Cl.
CPC ..... *A24F 40/485* (2020.01); *A24F 40/65* (2020.01)

(58) Field of Classification Search
CPC ..... A24F 40/485; A24F 40/65
See application file for complete search history.

(56) References Cited

U.S. PATENT DOCUMENTS 10,178,879 B2 * 1/2019 Glaser ..... A24F 40/485
11,369,148 B1 * 6/2022 Glaser ..... A24F 40/65

* cited by examiner

*Primary Examiner* — Jean F Duverne
(74) *Attorney, Agent, or Firm* — Sam Pierce

(57) ABSTRACT

The present invention applies to vape type devices also known as e-cigarettes and e-cigars. To expand the capabilities of Vape type devices, added here is programmable multi mixable flavors and wide temperature controls per flavor, programmable flavor sequencing as well as a self-cleaning capability. A "green" feature includes vaping by way of non combustion techniques. "Green" in context means non carcinogenic. The continued expansion of settings where it will be acceptable to allow the use of Vape type devices is represented by the exhalation filtration feature, which is offered with a wider bore than the intake bore to permit a more comfortable exhalation. The novelties of more than one flavor and temperature controls are included in this invention. In order to avoid having to carry two devices, a Vape device and a filtration type device, the two are merged into one convenient device for portability, the larger exterior bore device to further act as a stand reducing table top foot print use and provision of the addition of some electronic features included for locating the device, theft avoidance and to electronically certify the user has diligently utilized the filter in public or regulated spaces. The added novelties increase the versatility of the device and satisfaction of the user, providing more than one flavor in a single draw and the opportunity to deliver a "cool vape" experience. With these increased functions, the use of the device for medicinal purposes and homeopathic purposes increases in potential. With the advent of mixing flavors and use for drug delivery or homeopathic product delivery, the output filter is important in order to allow one to use the device as a personal comfort, while not detracting from anyone else, even in extreme close proximity.

20 Claims, 5 Drawing Sheets

E-CIGARETTES, E-CIGARS, VAPE-DEVICE PUBLIC SAFETY AND PROTECTION MECHANISMS

BACKGROUND

Vaping uses auto combustion, so the user is not required to combust anything, cannot start a fire, can use Vape devices in bed. In part, these devices typically rely on human power for the movement of air. It's not a cigarette and it's not a cigar. There is an electrical or electronic element utilized to efficiently convert fluid to vapor and the vapor carries a scent and may also carry nicotine and other chemical agents.

Filtration was used successfully on cigarettes on the intake side to try to capture some of the tar and other harmful byproducts of combustion during inhalation. In Vape settings, filtration of the exhaled content is still a desirable feature protecting the surrounding environment. People and animals benefit from not having to share in inhaling the various contents of the Vape mechanism in use. Add to this thinking the high pluralities of Vape devices concentrated in a public space and the problem is better illuminated. In fact, Vape exhalation will affix to such things as carpet, cloth, curtains, seat covers, people's clothing, so it really is an issue. Also, the combined chemicals of a plurality of Vape type devices would be unknown, inclusive of the potential for illegal substances emitted into the air, where children will inhale them. This is unacceptable.

City, County, State and Federal law may eventually mandate all vaping devices to filter their exhaust, or, the public cannot use Vaping in public places. Carriers such as bus, train, plane, may mandate use of Vaping with filtration with or without the law mandating it, by way of patron demand.

Vape devices require cleaning, from time to time, and the more flavors introduced suggest more frequent cleaning. Drug delivery and homeopathic product delivery exacerbate the problem of secondary inhalation.

Examples of prior art fail to provide a public-friendly vaping-type method of tobacco, or other substances traditionally consumed by smoking and vaping.

U.S. Pat. No. 5,160,518 Requires you to change exhalation paths. It used a U shaped tube to capture any excess smoke and pull it through. It never claims to get all the smoke, admits it can only get some of it. It is built around a miniature fan and requires power and the fan to operate. It suggests a method to filter exhalations, but without preventing an associated interference with the act of inhalation, thus greatly imposing on the user.

U.S. Pat. No. 6,814,083 monitors exhalation but does not provide means to reduce or eliminate dissemination of associated products into the environment.

U.S. Pat. No. 4,083,374 Provides a method for reusing exhaled smoke by using a bag, but eventually allowing the bags contents to pass unimpeded and unfiltered into the environment.

SUMMARY

An important feature of the invention is to provide multi flavors which can be mixed automatically, and delivered in variable sequences. Further, individual flavors can be heated or cooled to safe temperatures by the device. Continued sufficient filtration for the exhaled portion in using a Vape device of this type is provided. The filtration should be sufficient to cover a completely charged Vape type device through to the end of the device' capacity, or through several cycles if possible, based on the limits of the filter to where the filter must be replaced or cleaned. Capture of drugs and homeopathics may mandate use of catalytic converters in addition to paper, fiber or porous filtration means and methods. Other features including loss prevention, light, sound, use of the device as a stand, will be discussed below.

Vaping is not as nauseating to non using third parties as cigarette or cigar exhalation etc. . . . but it can still be very annoying and governments will pass laws prohibiting vaping in various settings. For example, no one even knows to what extent a Vaping individual could cause harm to another individual who is allergic to the exhaled content. Bear in mind, the surrounding people do not have any warning as to if the Vapor carries nicotine or other drugs, and certainly new mothers will not want their children to have to inhale nicotine. This invention can eliminate the exhalation content for the most part, 98% up to and including 100% very comfortably, so it seems certain that opinion as to where, when and how people Vape in public places could sway favorably for the Vaping public. The present invention provides a solution for the above and other problems associated with Vaping.

For purposes of this invention and as a non-limiting example, substances used for vaping are considered to include tobacco, nicotine, other legal "uppers", *cannabis*, (in places where legal) fruit, vegetable and spice-based smoking mixtures, legal drugs or combinations thereof. 'Vaping' is defined according to its common definition as referring to the heating or conversion to breathable aerosol, without combustion, of such substances for consumption extraction of resins, flavoring, or related components.

This invention comprises the novelties of delivering within a single draw, more than one flavor. The temperature of each component can be controlled and this may include low to very low temperatures, or higher temperatures compatible with humans, so as not to cause any physical harm. A single draw could produce a mostly chocolate cocoa flavor vapor with a deliberate touch of spearmint which has been cooled to 10 degrees f at the delivery point. The two flavors could be timed, wherein the primary flavor predominates the draw event and the secondary flavor is added just at the end, at a different temperature. This technique is found in many food groups, such as the art of mixing wines, tobacco, coffee, tea, and cross food groups such as enjoying wine with cheese noting specific combinations as more enjoyable than others. This feature set suggests the outbound filter is even more desirable to avoid bothering or exposing others to the output.

Sensory is present on the tip of the device to perform temperature acquisition and spectral analysis directly from the lips of the user. Identity can be determined in part, by spectrum analysis over time. Spectral analysis can determine the body temperature of the user. Spectral analysis can also determine the presence of non human proteins indicating infection. The device is thus prepared in real time to detect infection by way of body temperature rise and the sudden presence of non human, yet "able to be identified" proteins.

Bio Sensors are present in likely holding areas on the device to detect biometrics and multi-biometrics identifying the user and barring unknown user usage of the device. These data can work in conjunction to determine identity. In this context, the vape device becomes a real time detector and quarantine suggestive mechanism to safeguard the billions who inhabit this planet. The same concept could be used on cell, tablet, electronic keys all paired together to boost battery time and processing, as well as provide better access to larger networks for instructions on quarantine and rapid therapeutic action(s).

Multi Tanks and pathways (two or more) with each pathway, where each pathway may use a unique form of vaporization technique, along with pathway switching, can create vapor at controlled temperatures to include cold temperatures, then combine the vapors or emit them in a given sequence and with controlled duration per each pathway and thus, each flavor. A single pathway can do this, as well as performing the same function near the inhale point on the device. In this manner, one could load this vape device with 2 or more flavors per pathway and have what amounts to redundancy.

Internal Peltier circuitry can assure "all solid state" warming, cooling. Temperature sensors can be included to provide feedback to a central processor for utterly controlled creation of vapor. An internal light source and light sensor can be arranged to allow the light sensor to detect color well enough to know the pathway is clean or dirty and how dirty the pathway may be. These data suggest the timing and length of self cleaning cycles. Given these mechanics and connections with the switching and computer control, the entire device and its entire set of abilities becomes utterly programmable, and in as many cases as is desired, fully automatic in its functions. Settings may be shared with other vape devices, so perhaps hundreds of "tweaks" to the programming are shared in a single action, from one user to another. The settings could be transferred in common communications, such as an attachment to a communication, where an app detects the transfer and offers to the user to enable the settings under a single command. Eg Mike's double chocolate experience with Winter Breeze finish.

The tip can be deliberately fashioned from compatible materials which offer flavors and may include a candy type tip for allowing the tip to be consumed, thus reducing waste in landfills.

It is noted for drug delivery and homeopathics, the device will benefit from a self cleaning mode where a tank or all the tanks are filled (or the tank replaced with its contents) with a cleaner affluent not intended to be inhaled, hence, the programmability of the device can bar this possibility, or, the cleaning mode is done with a different tip installed which prohibits inhaling. Cleaner can now be heated by the peltier circuitry for a more thorough cleaning. As much as is possible, using an affluent that is not toxic is desirable, hence if inhaled, it would cause no harm. A trace color, flavor or both could be included to remind the user, this is the cleansing cycle vapor and not intended for use other than cleaning. A cleaning cycle could also require the unit to be in a stand, or at a certain angle, once started, the unit is not disturbed or it disrupts the cleaning cycle. In this manner, users will not inhale the cleaning cycle vapor.

Exhaust filters and catalytic converters are suggested to include that which captures exhaust components at the molecular level. As with the Diesel Engine industry, it is possible now to achieve an absolute zero noxious output, capturing small molecule components and yielding a true Zero output. This becomes increasingly important for drug and homeopathic delivery. Paper, ceramic, charcoal and metal surfaces are used as filters, with electric fields applied and differing temperatures to cause affixation of exhaled components wherein, it is possible to achieve a ZERO emission feature, emitting no harmful substance from the device, to the public, when used as intended.

The combined features yield yet additional features such as the ability to dynamically regulate dose, record dose, deliver dosages and record build up of the dose in the blood by successive reading from the spectral tip sensors and holding sensors. More than one drug can be delivered at the same time. The device thus becomes personalized as one uses it to deliver needed therapeutic or preventative drugs. The device, through its programmability, can become a perfect, personalized drug delivery tool. Multiple compatible drugs can be delivered at the same time. The tanks and cartridges could be equipped with a processor and a memory, as well as power (Battery) so as to be loaded into the device, used to deliver a dose and then removed for storage. The tank/cartridge specifically carrying the drugs "remembers" you took your dose and adds this factor to the whole set of information available at the device and any paired device, such as cell or tablet (or laptop), to avoid over dosing the drugs in question. Per se, once the cartridge delivers your dose, its programming will not allow another dose until X time expiration or an emergency override is issued requiring a command and password, for your protection. This could include requiring a Dr to issue a change to your prescription which is loaded automatically, electronically, through the network connections in the device and for more power to expand the network distance (such as sharing on 4G or 5G), use of the shared device' enhanced capabilities (eg cell, tablet, laptop and hot spot)

An additional chamber can be included to clear the delivery pathways so as to allow vape delivery without contaminating the vapor with drugs and vice versa (not contaminating the drugs with vape components through cleaning between cycle use) Rather than interchange tanks, one tank could be a clearing and cleaning tank that is always present in the device.

An exhaust feature requiring an automated outlet can emit vapor which is known to be visible in the atmosphere (smoke) for purpose of creating a perfect smoke ring, smoke triangle, smoke square, combinations of 2 and 3 dimensional shapes up to and including 2 and 3 dimensional sculpting of the output. Indeed, a picture or hologram could be emitted if the atmospheric conditions are right (static and smooth atmosphere) appearing a a hologram or image to users observing. Colorizing certain regions or pixels forming this image is possible by way of the components available in said device (vapor with color)

User side cameras and exhaust side cameras may be equipped such that standard use does not block them and they can reliably capture a snap shop of the user when they vape and optionally, take a shot of the surroundings with the far end camera as well. The camera will be capable of video and may double as a projector (U.S. Pat. No. 9,065,893 discloses bi directional chips which function as cameras and projectors). For videos a dot may be emitted (eg red laser) so the user can see the center of the shot. The Dot is not recorded, and may be blanked out automatically using advanced digital signal processing. To improve memory capacity, the device can merely feed to a paired device such as a cell or tablet. A Memory stick can be incorporated and may mandate a new, unique form factor to reduce space required. The Projector is not limited to the device, it may project content from a paired cell phone or lap top extending the paired device' capabilities to display or project (or adding the capability where it was not present prior).

As electronic innovation increases, by pairing with cell, all functions of cell logically deployable through the vape device can come into play. Touch to pay, where vape device is really an antenna and telemetry transceiver extender.

(repeater). On board chips to accomplish this. As is well known, one chip can do it all through VVLSI and custom design of the chip.

Flash light function can be included, given the shape and how a vape device is held, allowing for one more convenience in the overall design, much like a cell. A user settable timer is included to quench the flashlight feature. A photo sensor can auto quench the flash light if the device moves from dark areas to well it areas, all programmable under the user's control.

Sensor at far end (exhaust end) used to gather visible light spectral data and XLS data for remote XLS and analysis feature. This device is wand-like and can represent a means to gather data. Data such as radiation presence, xray analysis, nano magnetic resonance, could allow the vape device to have a control (button or command) where the user just wants to know what something is. Laser could be used as pointer so when you execute this command you know what the info you receive is sourced to (target). Much of this could be independent, or, dependent upon the device the VAPE device is paired with.

If the VAPE device detects that it seems to have been lost, it could emit a code on its display which pays for shipping and routes the device to the user. That way, someone finding the device is told, by way of the display, to drop the device in the mail at a post office. The same code (qr or bar) could offer the discoverer credit to be used for some free postage to compensate the discoverer who mails the device to the user.

A tank within the device may carry a neutral humidifier solution, such as deionized water. Said solution prone to freezing is monitored as to its temperature and adjusted accordingly. The internal temperature of the device is monitored with temperature sensors and the device can send warnings to its paired device, should it become too cold to avoid damage due to expansion of internal water based components. The heater element may be deployed to attempt to keep the device from freezing and maintain optimal internal temperatures. Humidification solutions are deployed under programmable settings to alter the mix of any one vapor or any combined mix of vapors to increase user comfort and acceptability.

In an embodiment an automatic self cleaning is performed per use of the device, per "puff" to enhance the flavor of each least common denominator use. In an embodiment the device may aerate content, or eject content into a bladder due to detecting near freezing temperatures and it may base this decision to vent to a bladder on remaining power so as to reduce interior content enough to avoid any damage to the device should the content freeze. The device can also warn the user when the device must be placed in a warm spot to avoid freezing and avoid damage caused by freezing.

In an embodiment the device may create vapor in any given pathway by way of compression, rather than combustion, which may be accomplished with piezoelectrical crystals, magnetic controlled plungers and sized chambers acting like a fuel injector would to a cylinder head. Vaporization can be achieved without combustion and changes the way a substance will be sensed and tasted by the user. It may also reduce carcinogen(s) creating a green vape type device (safe, non damaging to the user).

DETAILED DESCRIPTION

Figure 1:
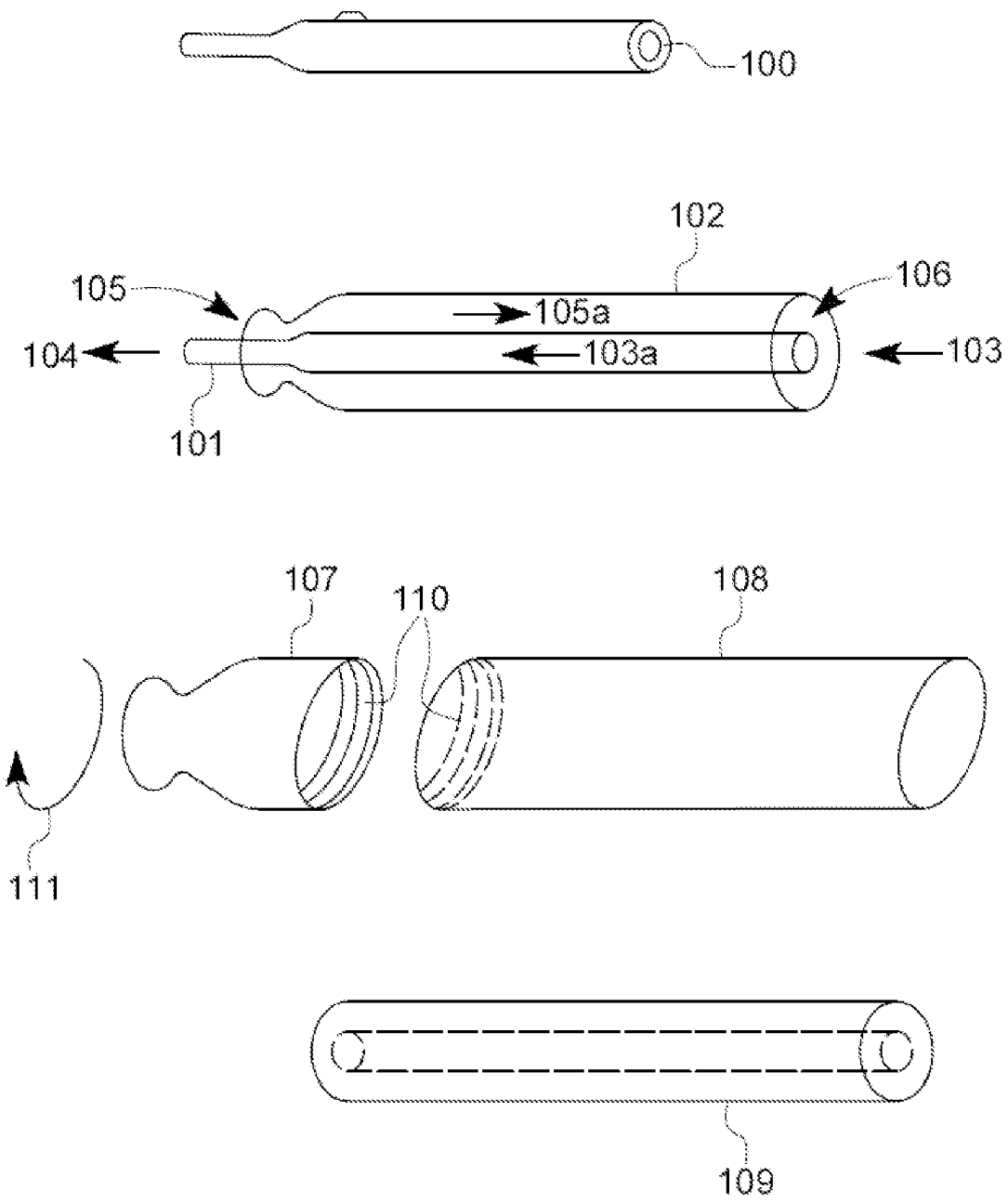
FIG. 1 Shows example of an e-cig 100 of the present invention.

Referring to FIG. 1, shown is an example of an e-cig 100 of the present invention having inhalation tip 101, external body 102 of a combined e-cig and filter, inhalation port 103, pathway and direction of inhalation flow 103*a*, inhalation point 104 where vapor enters the user, exhalation tip 105, exhalation pathway 105*a* and direction through filer where filter is not shown in this figure, exhalation port 106 and direction, one half of the filter housing 107, other half of a filter housing 108, fiber filter 109, screw threads 110, a direction 111 of force needed to couple the housing halves.

Referring further to FIG. 1, in accordance with the present invention, the e-cigarette also is used by the user to exhale through it. In a highly-preferred embodiment filtration of the user's exhalation occurs thereby. Using the same orifice and bore size that served the inhalation dose is not perfectly effective because it's too small a bore for exhalation, providing too much back pressure and the filter size would be reduced which has its obvious disadvantages. In this invention, blowing on or through the device pressurizes it, the filter is big enough to supply low additive pressure and most of the fumes would go through the filter, letting the filtered air, free of particulates, pass through the exhalation pathway 105*a*. Addition of catalytic converters (not shown) to the exhaust pathway will reliably affix molecular components such as sulfur based compounds and nitride type compounds, as non limiting examples.

In a highly preferred embodiment, the filter 109 holds the two concentric tubes in place. Alternatively, the space between the tubes may be maintained by any support needed such as a plastic ring, metal ring, grid or other such strictly structural elements.

An outer tip 105 exists around the inner tip 101 slightly deeper along the device and exhalation will switch the air flow either by having the user change tips for exhalation so as to reduce pressure by using a much bigger bore.

The present invention provides at least two pathways for air flow wherein the pathway toward the user 103*a* provides for vaporized substance while the pathway away from the user 105*a* provides, in at least an embodiment, for filtration utilizing one or more filtration means including but not limited to nano crystals, catalysts, liquids, solids, particulate filters, fibrous filters, carbon filters and other filtration mechanisms including electrostatic or electrolytic. 107 depicts a removable tip and the material from which this is made could be a flavor impregnated plastic, nylon, or, a consumable candy or edible treat.

Figure 2:
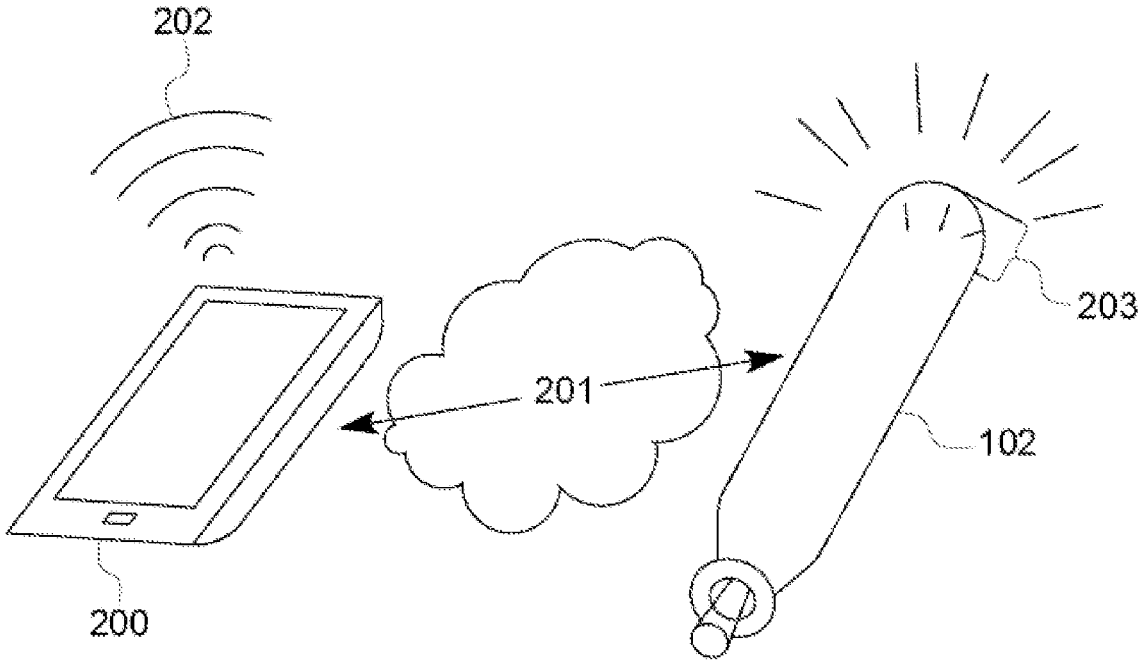
FIG. 2, in an embodiment, shows a cell phone 200 adapted for use with the invention depicted in FIG. 1.

Referring to FIG. 2, a generic cell phone 200 is shown having a wireless connection 201 between cell and e-cig of this invention 102, the wireless emissions 202 of the cell phone to various service providers such as 3-G network, 4-G network, 5-G network, Wi Fi, Bluetooth, NFC, RFID, cellular are shown generally as 201. Illumination 203 at tip which can also be at other places but not shown other than at the tip. This feature could be activated as a "find my VAPE" feature when lost, or, as an extension of the cell phone ringer, so one knows when one's cell phone is ringing. The reverse feature of find the cell phone when the cell phone is lost, could be activated and this same indicator could be used to indicate the VAPE device is in the "find the cell phone" mode with an appropriate unique flash pattern, color or both. 204 is a biosensor as with U.S. Pat. No. 9,065,893 (prior art) and is intended to detect the identity of the user and gather their spectral data. 205 is a user side camera. 206 is a far end camera useable by the user for taking snap shots and video images or projecting images. 207 is a laser pointer. All cameras, sensors and pointers are intended to be programmable.

Figure 3:
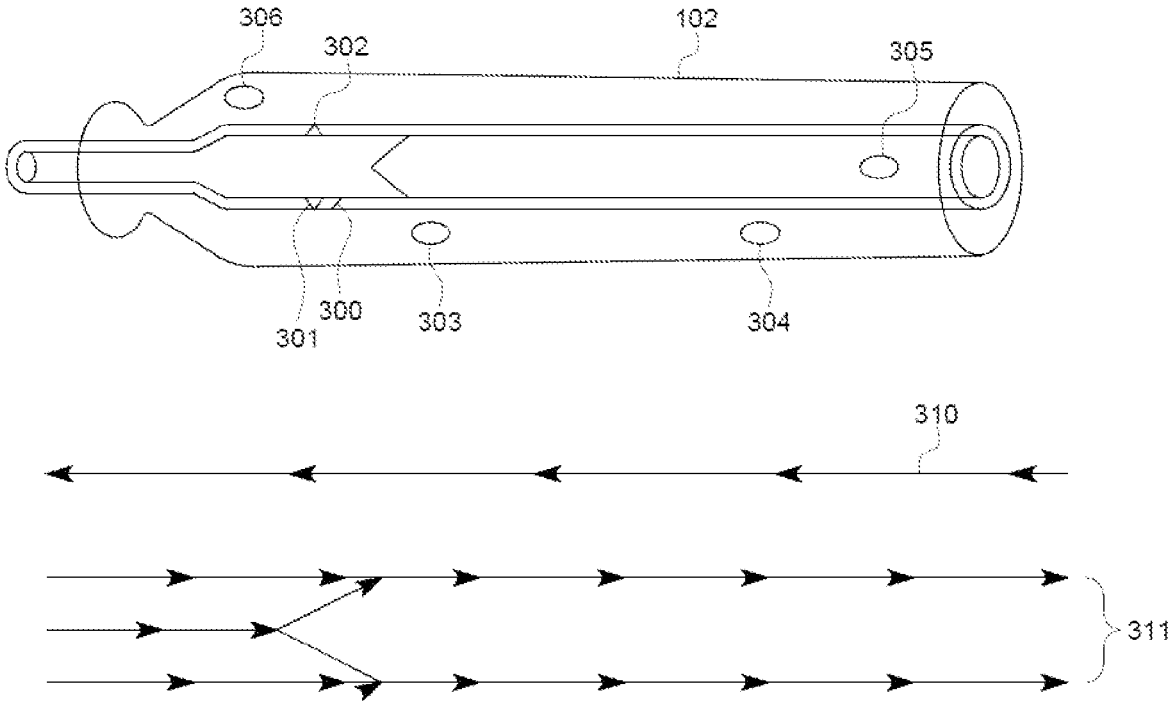
FIG. 3, in an embodiment, shows favoring the intake pathway through the use of an automatic one way valve with further automatic switching to an exhale pathway.

Referring to FIG. 3, In an embodiment, the user exhales through the smaller inhalation tip 101, causing a valve driven switching of airways to cause use of the filtration. An automatic one way valve 300 is shown favoring the intake pathway, one way valve 301 allowing pressure on the intake tip to be rerouted to the exhalation pathway, one way valve 302 allowing pressure on the intake tip to be rerouted to the exhalation pathway supplementing the first valve 301 for redundant operation, exhalation pathway sensor 303, exhalation pathway sensor 304, inhalation pathway sensor 305, exhalation pathway sensor 306, inhalation direction 310 through core of the device, exhalation direction 311 through the larger tip where any pressure on the smaller tip allows exhalation to be rerouted through valves to the exhalation pathway. Note that sensors are anticipated to sense pressure, volume, chemistry of the vapor and report this to any on board electronics (not shown). In an embodiment, sensors are placed in different placement and any one sensor may preferably be designed to perform as a dual or multi state or condition sensor. Sensor Embodiments include a flow, direction and volume determining sensor.

Valves 300 & 301 are preferably multi-flap valves, similar to a mitral valve, composed of nylon, somewhat resembling a heart valve. It may be preferable for the flaps to be triangular. Alternatively, a spring tension ball valve may be used. It may be preferable for the spring to be of stainless steel construction, nano-engineered to have an adequately low spring constant to respond, as described above, to a force produced by the breath of the user.

In an embodiment, a filter and catalytic converter are added into the airway or air pathway of the exhalation. It may be preferable for the inhalation bore and chamber to have a pressure driven switch, to allow the exhalation to use the same pathway up to the point of switching. This serves to clear the minute remaining Vapor from the inner inhalation bore pathway.

307 are biometric sensors capable of gathering temperature and spectral data of the user. 308 and 309 are peltier solid state circuits wired for creation of heat or cool (heat pumps with cool sides and hot sides) programmably changing the temperature of the vapor in contact with the circuit.

Figure 4:
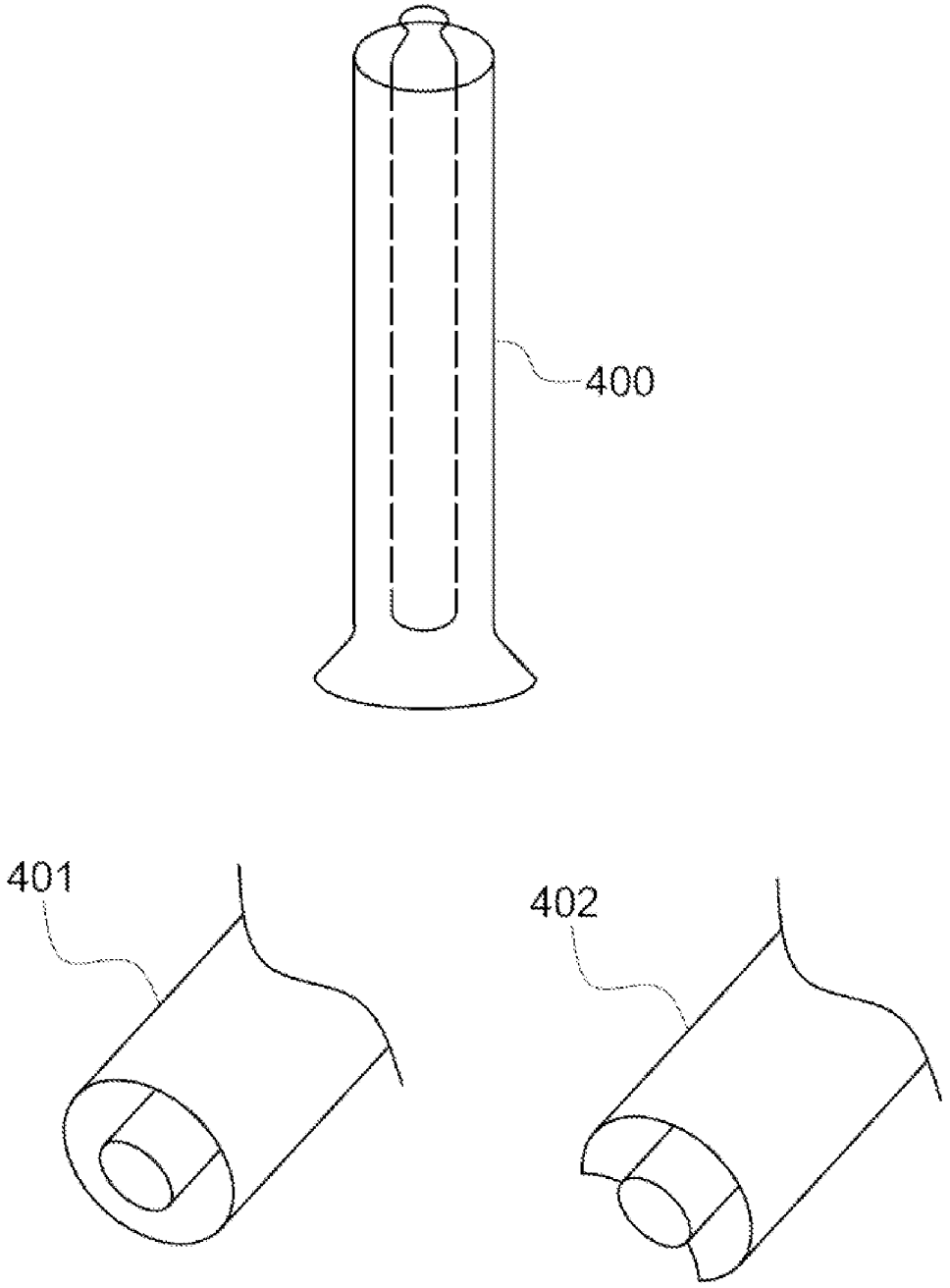
FIG. 4 shows the present invention, adapted for convenient use.

Referring to FIG. 4, in an embodiment, the present invention comprises a trumpet shape 400 you insert your cig into so a user could modularly convert any cig to this invention. The invention is contemplated for use either way, a separate item or built in on first purchase. Ecigs generally do not stand up. In an embodiment, the exhalation bell is a stand or doubles as a stand. This would slightly resemble a trumpet or trumpet shape. It may be preferable to add a counter weight to ensure balance. Also shown are elements 401, a regular tip and & 402, an alternative U shape which improves comfort for the user.

Figure 5:
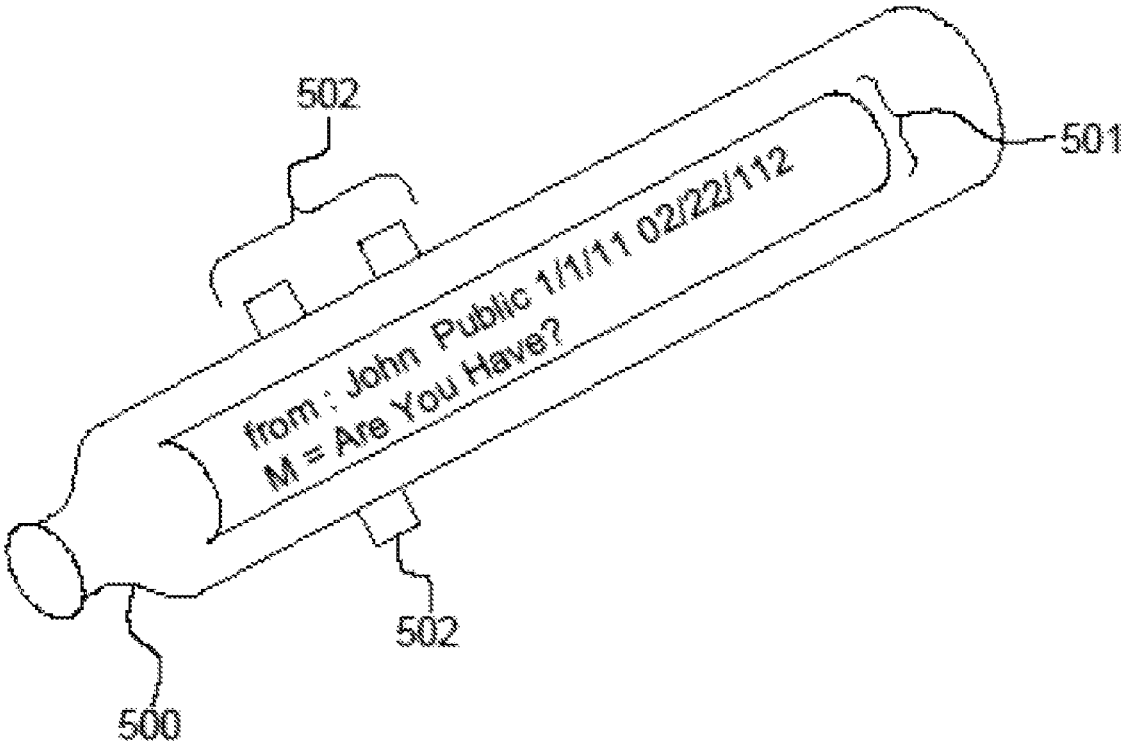
FIG. 5 shows the present invention with display and with more than one internal combustion tank.
Figure 5:
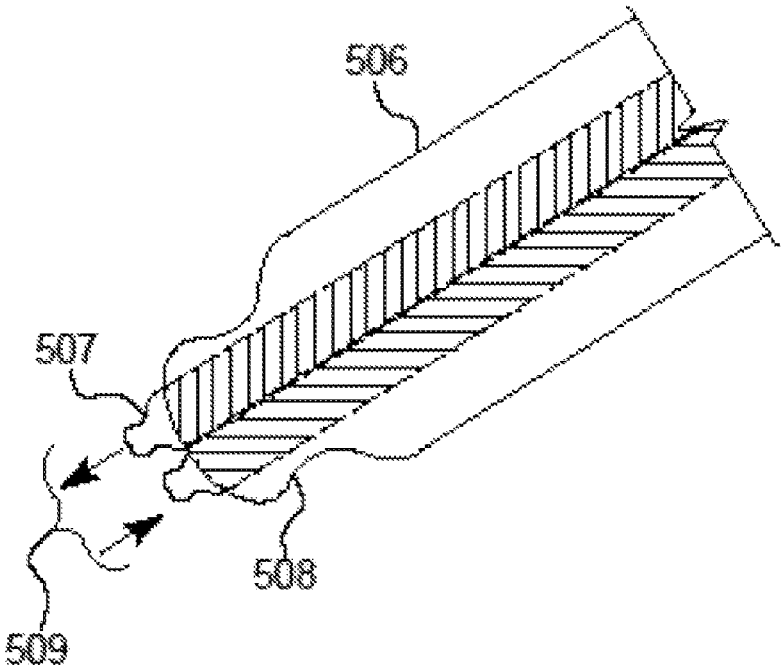

Referring to FIG. 5, 500 is the user side from which vaping will occur. 501 is a display which may be a touch display, offering regions which function as both display and touch sensor, as well as bio sensors and multibiometric sensors in the context of U.S. Pat. No. 9,065,893 (prior art). 502 represent button controls. 506, a cut away view of the VAPE device depicts combustion chambers 510, 511, which in turn can create differing products that merge at the tip 509, under the control of a switch 512. 508 marks the exhale end.

It may be preferable to add an RFID chip or bluetooth so as to mate it with your cell and watch, so you cannot lose the apparatus, as they may be expensive. A glow light for night time so you can see the end (vaping in bed, etc. . . . ) GPS locator, RFID locator, maybe disable it if its not on your person, such as x feet away from your cell or watch. Programmable, so you can set it to do different things from your watch or cell. Light and sound for locating it.

It may be preferable to provide an adapter so the device can charge from your cell battery or other portable electronics you have on your person.

It may be preferable to include a processor and sensors inside the vape device, to provide data to public systems assuring the vape user exhales the same volume of air they inhaled, through a filter that is functioning properly.

In an embodiment the present invention can be paired with other personal devices such that the distance between devices sets off an alarm at a preset distance. In an embodiment, when separated, the e-cig is disabled, so children who find it cannot operate it. The device pairing of the e-cig with another containing a display allows for the e-cig to communicate its status, report the filter percentage availability and any other parameters the e-cig has been equipped to report by way of sensors, processing and memory.

In an embodiment, the Vape device is paired with other electronics such that a display can run an application allowing for directional location of the "lost" e-cig of this invention utilizing such means as RFID circuitry contained within the e-cig and within the device seeking the e-cig, such as a cell phone equipped with RFID detectors and antenna'.

In an embodiment, the remote applications operated on such devices as a cell or tablet can cause the e-cig to illuminate, emit a sound or both and the illumination and sound can be changed from the application or, the e-cig of this invention can also initiate the sound or illumination or both. One such mode is an illuminated tip at either end or at both ends (or any portion of the e-cig desirable), to assist in locating or placing the device using the lighting to see where you wish to place the device during periods of ambient darkness. The app can have commands to cause the e-cig to emit sound or light, while the e-cig can have buttons for the issuance of the same commands or different commands.

In an embodiment, the e-cig of this invention can measure air flow of air in and out, allowing an on-board processor and memory (e-cig internal processing and memory) to calculate that the user has exhaled the same volume of air as was inhaled, to then provide this data electronically and wirelessly to external applications certifying the user is following local rules to protect bystanders who do not wish to inhale the vapor or any of its components. The accumulative effects of the vapor causing damage to surfaces, materials, clothing, upholstery and the like, are also avoided. The same sensors can detect if the e-cig of this invention contains a filter, if the filter is nearly full or otherwise needs to be changed or cleaned, including sensing escaping vapor which has not been as fully filtered as is possible with a known working filter.

In an embodiment, filtration may also include catalysts which convert exhaled chemicals to other chemicals. This may involve metals and metal plates, such as platinum or rhodium, to treat the exhaled portion of the vapor and convert or otherwise trap harmful chemicals. Other obvious filter components may include activated charcoal, carbon fiber, fibrous material and other high surface area filtration competent materials. Selection for biologically and environmentally safe materials is always a mandatory consideration. Recycling of the filters or devices can be encouraged and electronically enforced.

In an embodiment, the associated apps allow the user to calculate the total air flow in and out for informational purposes and in a "terms of service" (TOS) agreement, can be shared with external applications to see if a better deal for the device and its recyclable components, filters, consumables and distillates or additives can be found.

In an embodiment, the e-cig of this invention is biometrically activated and deactivated by the user such that the loss of the device does not result in other users utilizing the device, protecting the primary user from any claim of damage to a secondary user. In embodiments, this function is automatically activated and/or deactivated. Additionally, a simple password lock out feature could also be provided, wherein, if the device is turned off or its battery dies, or, if the distance from other user devices triggers the alarm, the device locks out. This protects such individuals as a minor from Vaping from the user's e-cig of this invention.

In an embodiment, the e-cig of this invention has circuitry which allows the device to put on a modest light show in sync with music playing in the ambient surround. This includes a mic, sound processing and visualizer software as well as processing, memory and ideally, multi-color Led backlighting or other forms of light source. In an embodiment, the same function is operated automatically across a group of users.

In an embodiment, the e-cig of this invention networks with other e-cigs which surround the user by way of their unique user's electronic devices, to allow a network mapping of all the e-cigs in proximity to, for example, allow a master controller to create a light wave in a stadium under the control of an external application. It may be preferable for text or other graphics to be emitted, visible from a distance wherein each user represents a pixel or pixel group.

In an embodiment, the successful logging into the e-cig of this invention wherein settings have allowed this feature, it may be preferable for the e-cig to emit a jingle (audible sound) and light pattern unique to the manufacturer of the e-cig.

In an embodiment, the e-cig of this invention uses a bio sensor to emit light which corresponds to a mood of the individual user. It may be preferable to have a setting to set a light which indicates the social availability of the user, such as single. This is of interest to users in social settings, such as a dance, a bar, a stadium or theatre lobby.

In an embodiment, the e-cig of this invention includes circuitry which networks with surrounding networks to enable features law enforcement and venue owners may appreciate, such as assurance users are using the devices where designated, users are exhaling through their device and the light or sound features are suppressed to avoid disturbing other users in the area with an override function to find a truly lost e-cig of this invention. This provides assurance in a movie theater setting, as one example, or on a commercial aircraft as another good example, the e-cig of this invention is not viewed as a nuisance or annoyance to other people in proximity.

In an embodiment, the outer casing containing the filter is fashioned to modularly fit over an existing pre-manufactured e-cig type device. Alternatively, the invention could function as a combined solution as illustrated herein, sold as a combined e-cig and filter system.

In an embodiment, it may be preferable to filter on the inbound side for the user.

In an embodiment, e-cig operation is shut down by way of an agreed-upon standard to electronically signal such devices which work directly, or indirectly through an app on a cell phone or tablet to ask the user to shut down, while the system still has override capability and will forcibly shut down the Vape device. This would logically apply based on the user's location or per an agreement during travel for the device to auto operate and auto non-operate when and where the application allows, so the user still has some limited access.

In an embodiment, the combined e-cig filter device of this invention further includes valves which allow a comfortable inhalation, while combining two tips for exhalation, wherein the user selects the larger of the two concentric exhalation tips which still puts pressure and passes air through the smaller tip, invoking valves which assure all exhaled product goes through the filtration.

In an embodiment sensors reflect the use of any substance outside of what the user programs in and/or the device senses and reports the use of each substance utilizing sensors to detect them. For example, a user owns a vaping device, which is stolen and hacked past security. The user finds out as the device reports it. Alternatively, as an example of a method of the present invention, the use of an illegal drug is detected by sensors and reported via WiFi.

In an embodiment, liquids used as filtration substances are displayed in a bulbous form wherein the form uses as a weight to keep the device vertical when set down on a surface. Rather than a trumpet shape, the base could take on most any form that contains the liquid, and the liquid used for filtration need not be exclusive as to the filtration means, such as a two stage or three stage filtration device. The light emissions of the device could leverage the presence of the liquids to act as a transmission medium expanding the light emission volume.

In an embodiment, the device may contain chambers which are volumetrically larger at one end, than at the other, proffering stability when the device is set upright on one end, the end being heaviest that is used as a base.

In an embodiment, the chambers are connected thermally to peltier circuitry which may heat up or cool down vapor before it is delivered to the user through the switched or direct pathways. Vapor can be mixed and temperature regulated by the programmable processor on board. Vapor(s) can be delivered in any logical mix by routing through the device under the programmable controls. Humidification of any one vapor, or all, is done by having a humidity source, such as sterile water (distilled), forming pure steam which may humidify a vapor causing a more comfortable experience for the user.

In an embodiment 2 or more chambers may be used to generate 2 or more flavors wherein the flavors are thereafter switched to be delivered to the user in programmable, measured output which includes thermal control, as well (and humidity).

In an embodiment the device can emit vapors from the exhaust end using computer controlled orifice(s) which print the smoke to the open atmosphere. As such, coordinated programming can emit 2 and 3 dimensional shapes of any form and even print 2 and 3 dimensional scenes.

In an embodiment, a tip which is disposable may be impregnated with a flavor, or the tip could be formed of an edible substance with flavor embedded.

In an embodiment, the near end and far end of the device are equipped with cameras which may take snap shops or videos, such as to automatically take a shot for each draw, permanently recording who used the vape device. The near and far end cameras can function as any camera may, including the taking of videos. The device is equipped with a laser pointer which assists in taking rapid videos or still shots of objects in proximity to the user.

In an embodiment, sensors are provided on the device such as are used in U.S. Pat. No. 9,065,893 (prior art) but not limited to that class or form of sensor (meaning any bio sensor would be sufficient) in order to determine who the user is.

In an embodiment, more sophisticated bio sensors can monitor the health and temperature, the spectral image of the user and can report changes, including sudden presence of a viral or bacterial protein which humans emit when they contract a disease. These may, for public policy reasoning, report in real time to authorities.

In an embodiment, any use of the device not authorized by the owner may shut down the device, beacon the owner, send communications to the owner or other parties, per terms of service or rule of law.

In an embodiment, the device may be used as a simple flash light.

In and embodiment, the device may be equipped with sensory at the far end so the device can be used as a probe to remotely gather telemetry and pass it to the paired devices, such as cell and tablet, for purpose of identification of a given target. The laser pointer could be used to pick a very small target and target area for purpose of spot identification of substances down to the atomic and molecular make up.

In an embodiment, when used to deliver medicinal or homeopathic type substances, the delivery can be metered, measured and then tracked by way of the sensors of the device, so as to know the user's demand for dosage, deliver said dosage, measure the levels of dose in the user's spectrum and adjust the dose immediately (just in time) to be effective for the user. Dosing of one or more substances can be concurrent if the drugs themselves are compatible for delivery at the same moment, as a vapor. Nothing herein limits the device to vapors only. The device could be further modified to deliver drugs and homeopathics via a liquid output for swallowing rather than inhaling, which may use the same tip as is used to inhale, or yet another tip not shown.

In an embodiment, under computer controls, the device and its drug bearing cartridges could keep track of who dosed, when they dosed, how much they dosed so as to assure no over dosing of the user. The dosing mechanisms can refuse to function without password controls (or audio logging) and some bio sensory to assure the user is known. Through data mining, automatic ordering of the user's drugs and homeopathics can happen per the user's preset instructions.

In an embodiment, the tip is thermally conductive, peltier circuitry is thermally connected to the tip, tip is thus temperature controlled. Design is such that peltier cannot run away with temperature making it too cold or too hot. Thermal regulation can be build in with redundancy using 2 thermistors in series with the peltier heat or cool sink. Cool Vaping can refer to the tip and the experience as the content that arrives through the tip may also be cooled to desirable temperatures.

Note that on board processing, memory, battery, vape specifics or electronics, wireless transmission circuitry and antenna have not been shown as these elements are typically so small, they do not affect the overall design, or alternatively, they can easily be worked into the design as those skilled in the art of electronics CAD CAM understand, as well as those skilled in VVLSI, miniature electronics and 3-D Printing.

Those experienced in the field of this invention should, based on the detailed descriptions of the objectives and new methods, be able to understand the logical possible variations. They will be able to adopt appropriate strategies, dimensions and geometries depending on the various applications and needs of vaping devices, not specifically shown in this application, but within the general goals and objectives of this invention.

Examples disclosed are intended to be limiting only as reflected in the claims.

The invention claimed is:

1. An e-cigarette device comprising;

a first chamber with directional air flow allowing for the inhalation of air containing additive smoking or vaping substances, a second chamber for exhalation, having a greater bore than and surrounding the first chamber, a mouthpiece connected, at an end proximal to a user, to at least one of the first and second chambers, separation means disposed intermediately between the first and second chambers and maintaining the first and second chambers in substantially fixed relation, a biometric sensor situated on an area of the device in occasional contact with a user of the device, a microprocessor in communication with the biometric sensor, a digital memory in communication with the microprocessor.

2. The e-cigarette device of claim 1 further comprising;

a unit executing code on the microprocessor and capturing spectral data pertaining to a user from the biometric sensor and storing the data in the memory, a unit executing code on the microprocessor and effecting an analysis of the data.

3. The e-cigarette device of claim 2 wherein the analysis identifies a nature and concentration of a substance.

4. The e-cigarette device of claim 2 wherein the nature pertains to a sugar.

5. The e-cigarette device of claim 2 further comprising at least one additional sensor capturing additional data and a unit executing code on the microprocessor and effecting an analysis of the additional data.

6. The e-cigarette device of claim 2 wherein the data is captured at multiple points and Artificial Intelligence is utilized to determine reasonableness and accuracy of the net sum reading.

7. The e-cigarette device of claim 2 further comprising an output device effecting a communication to the user.

8. The e-cigarette device of claim 7 wherein the communication comprises an instruction to automatically "dose".

9. The e-cigarette device of claim 2 wherein dosing is inhibited based on the biometric determined identity of a given user.

10. The e-cigarette device of claim 2 wherein the separation means comprises a filtration means.

11. The e-cigarette device of claim 2 further comprising at least one valve wherein the exhalation of air reversing air flow causes the valve to close.

12. The e-cigarette device of claim 11 wherein the first chamber comprises a bore sizing which provides a comfortable draw and flow of inhaled air and vapor additive, while the second chamber comprises a bore sizing which facilitates a comfortable exhalation, the second bore comprising a greater overall bore size and reduced back pressure.

13. The e-cigarette device of claim 2 wherein the communication between the microprocessor and the biometric sensor is effected by near field communication.

14. The e-cigarette device of claim 2 further comprising means to permit free-standing when disposed on an end.

15. The e-cigarette device of claim 14 wherein the means to permit free-standing comprises an exhalation bell having a substantially trumpet form flared at an end of the device distal to the user during use.

16. The e-cigarette device of claim 14 further comprising a second filtration means collecting filtered material in a liquid contained in a reservoir.

17. The e-cigarette device of claim 14 wherein the means to permit free-standing comprises a base of the reservoir.

18. The e-cigarette device of claim 12 further comprising a switch to automatically change the position of the at least one valve.

19. The e-cigarette device of claim 11 wherein the at least one valve is selected from the list of a ball valve or a flap valve.

20. An e-cigarette device comprising;

a first chamber and a second chamber with directional air flow allowing for the inhalation of air containing additive smoking or vaping substances, a third chamber for exhalation, having a greater bore than and surrounding the first chamber and the second chamber; and a mouthpiece connected to an end, proximal to a user, to at least the first and second chambers, a mouthpiece connected to an end, proximal to a user, to the third chamber, separation means disposed intermediately between the first, second chambers and third chamber and maintaining the first, second and third chambers in substantially fixed relation, a biometric sensor situated on an areas of the device and occasionally contacting a user of the device, a microprocessor connected to the biometric sensor, a digital memory connected to the microprocessor, wherein;

the first and second chambers comprise a bore sizing which provides a comfortable draw and flow of inhaled air and vapor additive, while the third chamber comprises a bore sizing which facilitates a comfortable exhalation, the third bore comprising a greater overall bore size and reduced back pressure, and wherein further;

the first chamber conducts a vapor-producing substance and the second chamber conducts a second vapor-producing substance.

* * * * *